US005637821A

United States Patent [19]

Izumisawa et al.

[11] Patent Number: 5,637,821

[45] Date of Patent: Jun. 10, 1997

[54] STORING AND INTERPOLATING MEANS FOR A MUSICAL SOUND GENERATING DEVICE

[75] Inventors: Gen Izumisawa; Yutaka Washiyama, both of Hamamatsu, Japan

[73] Assignee: Kabushiki Kaisha Kawai Gakki Seisakusho, Japan

[21] Appl. No.: 597,353

[22] Filed: Feb. 6, 1996

Related U.S. Application Data

[63] Continuation of Ser. No. 938,498, Aug. 31, 1992, which is a continuation of Ser. No. 678,527, Mar. 28, 1991.

[30] Foreign Application Priority Data

Mar. 30, 1990 [JP] Japan ..... 2-81187

[51] Int. Cl.[6] ..... G10H 1/02

[52] U.S. Cl. ..... 84/604; 84/607; 84/605

[58] Field of Search ..... 84/604–607, 622, 84/624, 625, 659–661

[56] References Cited

U.S. PATENT DOCUMENTS

| | | | |
|---|---|---|---|
| Re. 33,738 | 11/1991 | Ikumura | 84/605 |
| 3,763,364 | 10/1973 | Deutsch et al. | 84/604 X |
| 4,520,708 | 6/1985 | Wachi | 84/607 |
| 4,584,921 | 4/1986 | Wachi | 84/605 |
| 4,646,608 | 3/1987 | Deutsch | 84/623 X |
| 4,667,556 | 5/1987 | Hanzawa et al. | 84/625 |
| 5,146,834 | 9/1992 | Izumisawa et al. | 84/607 |

*Primary Examiner*—Brian Sircus
*Attorney, Agent, or Firm*—Adams & Wilks

[57] ABSTRACT

A musical sound generating device has a waveform memory to store musical sound waveform data to be read-out repeatedly between a loop-top address (integral address) and a loop-end address (integral address). The same musical sound waveform data is stored at the loop-top address and the loop-end address. An address computing circuit computes a read-out address, including a decimal part, to repeatedly read out the musical sound waveform data stored between the loop-top address and the loop-end address in the waveform memory. An interpolating circuit carries out interpolation if the read-out address generated by the address computing circuit includes a decimal part. Interpolation is carried out by dividing in proportion the musical sound waveform data read out from the waveform memory using an integral part of the read-out address and the musical sound waveform data read out from the waveform memory using a value obtained by adding 1 to the integral part of the read-out address according to the decimal part.

24 Claims, 6 Drawing Sheets

STORING AND INTERPOLATING MEANS FOR A MUSICAL SOUND GENERATING DEVICE

This is a continuation of application Ser. No. 07/938,498 filed Aug. 31, 1992 which is a continuation of application Ser. No. 07/678,527 filed Mar. 28, 1991.

BACKGROUND OF THE INVENTION

1. Field of the Invention

This invention relates to a musical sound generating device used in musical instruments such as a synthesizer, an electronic piano, or an electronic organ. More particularly this invention allows interpolating processing when reading musical sound waveform data from a waveform memory incorporated in the musical sound generating device.

2. Description of the Related Art

In recent years, application of electronics technology in the field of acoustic musical instruments such as a piano or an organ has progressed, and electronic musical instruments such as electronic pianos or electronic organs have been introduced into the market. Also, synthesizers which generate musical sounds with unique tones have been commercialized as an electronic musical instrument. This kind of musical instrument has a musical sound generating device (sound source circuit). A waveform memory which musical stores sound waveforms is incorporated in the musical sound generating device. The waveform memory incorporated in this musical sound generating device stores a plurality of musical sound waveform data corresponding to various tones.

In this kind of musical sound generating device, a musical sound signal is generated by selecting a piece of musical sound waveform data in the waveform memory corresponding to a tone specified by, for instance, a panel switch. The data is read at a speed corresponding to a pitch specified by a key to restore the musical sound waveform. This musical signal is supplied to an acoustic circuit. Then, the acoustic circuit drives, for instance, a speaker and a headphone, in response to the musical sound signal. With this processing, musical sound is produced.

In this type of musical sound generating device, a technique to compress musical sound waveform data and store it in a waveform memory has been employed due to the capacity of the waveform memory used in the device.

For instance, generation of musical waveform data of a musical sound having a tone is performed by separating a musical sound signal of the tone with a specified length (generally a plurality of frequencies) and sampling digitizing the separated musical sound signal at a specified pitch. Generally, separation of the musical sound signal is perform using a width of a specified length starting from the head of the musical sound signal. This is because features of the tone are often included at the onset of the musical sound signal.

Musical sound data thus made is stored in the waveform memory as a digital value, and the musical sound is generated by reading the musical sound data in a specific way.

Namely, to generate a musical sound with a tone, a specified length of a terminating block of musical sound data stored in the waveform memory (with either a plurality of frequency or a single frequency) is defined by a loop-top address LT and a loop-end address LE (both of which are addresses in the waveform memory). At first, the musical sound waveform data is read out from its head. Then, a continuous musical sound waveform is restored by repeatedly reading out musical sound data in an area enclosed by the loop-top address LT and the loop-end address LE, and the musical sound signal is generated.

On the other hand, the pitch of the musical sound can be controlled according to the speed at which the musical sound waveform data is read out from the waveform memory. However, if a system configuration allowing change of a read-out speed according to a pitch is to be implemented, a complicated read-out circuit is required.

For this reason, in actual application, a virtual sampling position (address including a decimal block) corresponding to a read-out speed in a waveform memory space is computed, and if the computed virtual sampling position does not match an actual storing position (integral address) of the musical sound waveform data, the musical sound waveform data corresponding to the sampling position of the virtual sampling position is computed by dividing in proportion a musical sound waveform data stored at addresses before and after the virtual sampling position (this process is called interpolation). The musical sound is restored depending on the computed musical sound data and the musical sound signal is generated.

In a musical sound generating device with a configuration as described above, a circuit to repeatedly read out musical sound waveform data in an area enclosed by a loop-top address LT and a loop-end address LE in a waveform memory performing interpolation is quite complicated, and also since the scale of the circuit becomes larger, the of cost of the musical sound generating device becomes more expensive.

SUMMARY OF THE INVENTION

This invention is extended to solve the problems associated with conventional musical sound generating devices as described above. An object of this invention is to minimize the scale of the circuit to repeatedly read out musical sound waveform data in an area enclosed by a loop-top address LT and a loop-end address LE which performs interpolation for providing a musical sound generating device thus reducing the cost of the musical instruments.

To achieve the purpose described above, a musical sound generating device according to the present invention has a waveform memory which stores musical sound waveform data to be read out repeatedly between a loop-top address (integral address) and a loop-end address (integral address) wherein the same musical sound waveform data as that stored at the loop-top address is stored at the loop-end address thereof. A means is provided for computing addresses which generates read-out addresses including a decimal part for sequentially and repeatedly reading out the musical sound waveform data stored between the loop-top address and the loop-end address in the waveform memory, and a means is provided for interpolation which interpolates a read-out address generated by said means for computing addresses. If the computed addresses includes a decimal part, the means for interpolation divides in proportion the musical sound waveform data read out from the waveform memory assuming an integral part of the read-out address as the address and the musical sound waveform data read-out from the waveform memory assuming a value obtained by adding 1 to the integral part of the read-out address as the address according to the decimal part.

When reading out and interpolating musical sound data from the waveform memory at a read-out address including a decimal number, regardless of whether the read-out address generated by the means for computing addresses is between an address increased by 1 ahead of the loop-end address and the loop-end address or not, interpolation is made. Interpolation is made by dividing in proportion the musical sound waveform data read-out from the waveform memory assuming the integral part of the read-out address as the address and the musical sound waveform data read-out from the waveform memory assuming a value obtained by adding 1 to the integral part of said read-out address as the address according to data in the decimal part.

Because of this feature, it is not necessary to determine whether the read-out address has surpassed an address by 1 ahead of the loop-end address or not, and accordingly hardware for detecting the address increased by 1 ahead of the loop-end address is not required, which allows minimization of the circuit scale and realization of a cheap musical sound generating device.

DETAILED DESCRIPTION OF THE PREFERRED EMBODIMENTS

Figure 1:
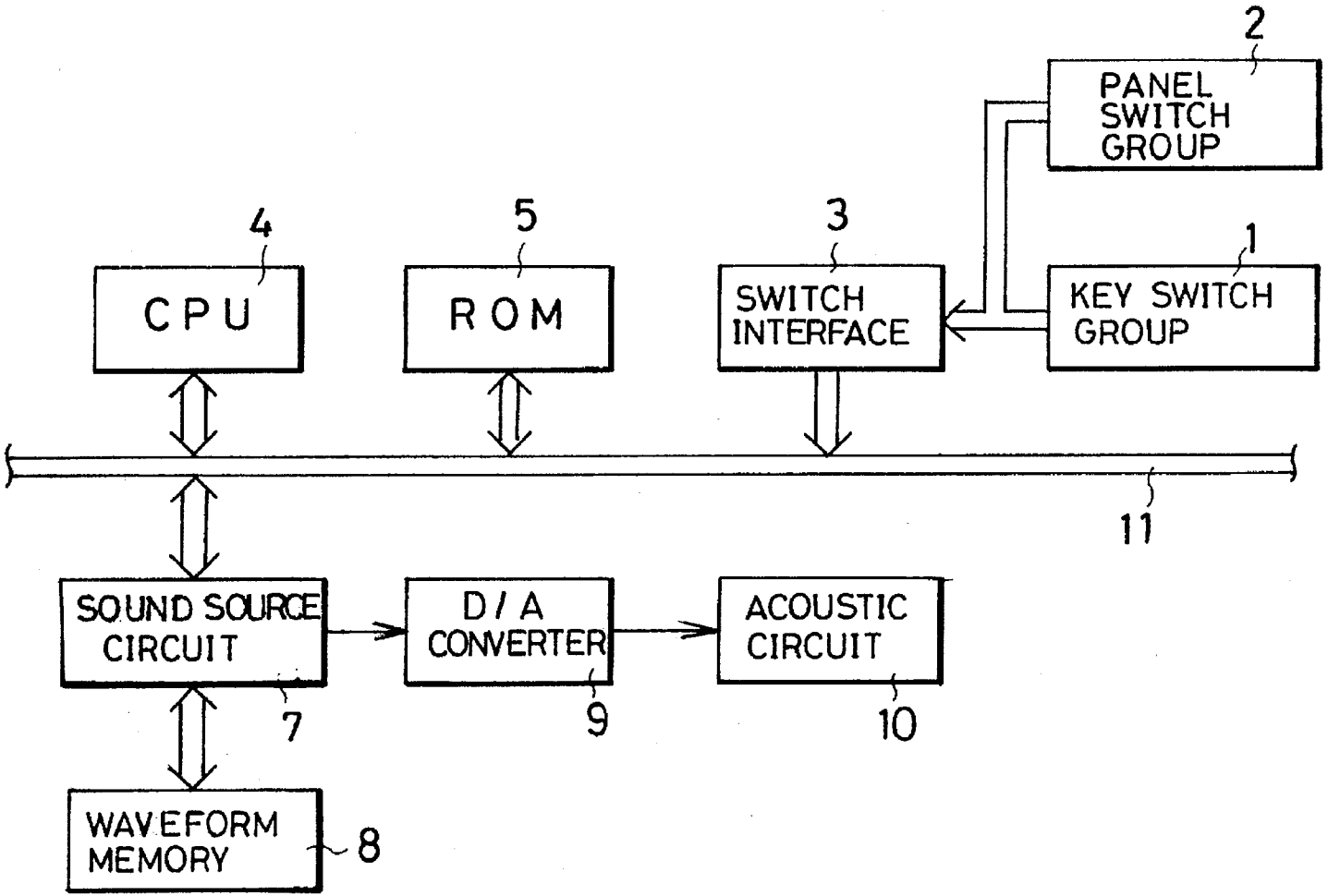
FIG. 1 is a block diagram showing the general configuration of an electronic musical instrument in which a musical sound generating device according to the present invention is applied.

FIG. 1 is a general block diagram showing an entire configuration of an electronic musical instrument in which a musical sound generating device according to the present invention is applied.

In this drawing, 1 is a group of key switches which detect a player's key touch or key release operations and send signals to a CPU 4. This key switch group 1 includes a key scan circuit to detect keys and depressed state of each panel. Signals from a key switch group 2 are sent to a switch interface 3. The panel switch group 2 is a group of panel switches including power switches, mode select switches, melody select switches, and rhythm select switches. Set/reset state of each switch is detected by a panel scan circuit incorporated in the panel switch group 2. Also signals from the panel switch group 2 are sent to the switch interface 3.

The switch interface 3 outputs data concerning the state of the key switch group 1 and the panel switch group 2, namely whether the panel switches are in the ON state, key code and touch for keys which have newly entered ON state, and key code for keys which have newly entered OFF state. Note that the touch information is generated by a well-known touch detecting circuit not shown in the drawing.

A central processing unit (CPU) 4 controls each block of the electronic musical instrument according to a program stored in a program memory block of a read-only memory (ROM) 5.

The ROM 5 includes, in addition to programs to run the CPU 4, tone data and other various types of fixed data.

A sound source, circuit 7 is directly related to features of this invention, to which a waveform memory 8 is coupled. Details of this sound source circuit 7 and the waveform memory 8 are described later. Digital musical sound signals output from the sound source circuit 7 are sent to a D/A converter 9.

The switch interface 3, the CPU 4, ROM 5, and the sound source circuit 7 are coupled to each other through a system bus.

The D/A converter 9 converts an input digital musical sound signal to an analog musical sound signal. The analog musical sound signal converted by the D/A converter 9 is supplied to an acoustic circuit I0.

The acoustic circuit 10 converts an input analog musical signal in a form of an electric signal to an acoustic signal, and generates sounds by means of sound generating devices represented by, for instance, a speaker or a headphone.

Figure 2:
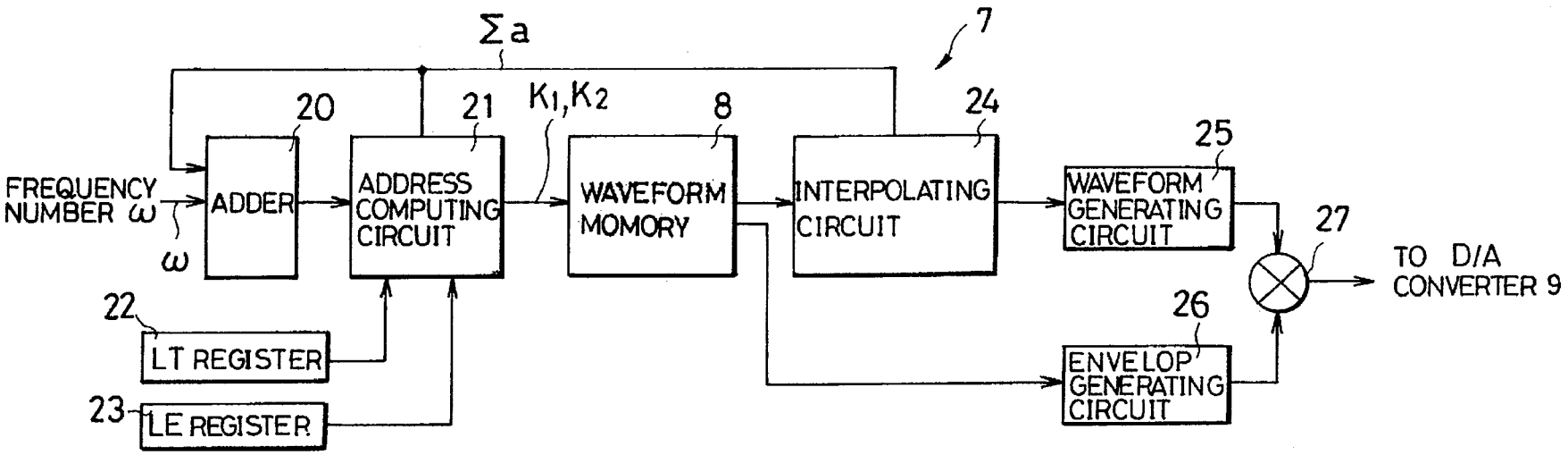
FIG. 2 is a block diagram showing a configuration of a musical sound generating device (including a waveform memory, and a sound source circuit) according to the present invention.

FIG. 2 is a block diagram of the acoustic circuit 7 and the waveform memory 8 in the electronic musical instrument in more detail.

Description is made for a configuration of the acoustic circuit 7 first on the assumption that, in addition to musical sound waveform data, envelop data is also stored in the waveform memory 8.

An adder 20 adds a current read-out address $\Sigma a$ stored in the address computing circuit 21 to a frequency number $\omega$ supplied from the CPU 4.

The frequency number $\omega$ is data indicating a pitch, or more particularly specifying a sampling pitch in an address space in the waveform memory 8. The frequency number $\omega$ is data including effective digits below a decimal point.

A result of addition by this adder 20 is supplied again to the address computing circuit 21, and stored as a next read-out address. Namely, an accumulator function is realized by the adder 20 and the address computing circuit 21.

The address computing circuit 21 stores a next read-out address, which was computed by the adder 20 as described above, and additionally provides control over repeated read-out operations according to each address value set in an LT register 22 and an LE register 23. The next read-out address $\Sigma a$ stored in the address computing circuit 21 is supplied to the adder 20 and the interpolating circuit 24. Also, an integral part $K_1$ of the next read-out address $\Sigma a$ and an integral address $K_2$ for interpolation are supplied to the waveform memory 8. The integral address $K_2$ herein is a value obtained by adding 1 to the integral part $K_1$ of the read-out address.

The interpolation circuit 24 supplies the musical sound waveform data read out from the waveform memory 8 according to the integral part $K_1$ of the read-out address and the musical sound waveform data read out from the waveform memory 8 according to the integral address $K_2$ for interpolation by dividing them according to the decimal part of the current read-out address Σa, or in other words interpolating them.

A waveform generating circuit 25 generates musical sound signals according to musical sound data from the interpolating circuit 24, and supplies them to a multiplier 27.

On the other hand, an envelop generating circuit 26 generates envelop signals according to envelop data read out from the waveform memory 8, and supplies them to the multiplier 27.

The multiplier 27 multiplies a musical sound signal from the waveform generating circuit 24 with an envelop signal from the envelop generating circuit 26. Multiplication of both signals generates a musical signal with an envelop signal added to it. The musical signal is converted by the D/A converter to an analog signal, and as described above, is released as a sound by the acoustic circuit 10 (Refer to FIG. 10).

Description is hereunder made for musical sound waveform data which is stored in the waveform memory 8.

Figure 3:
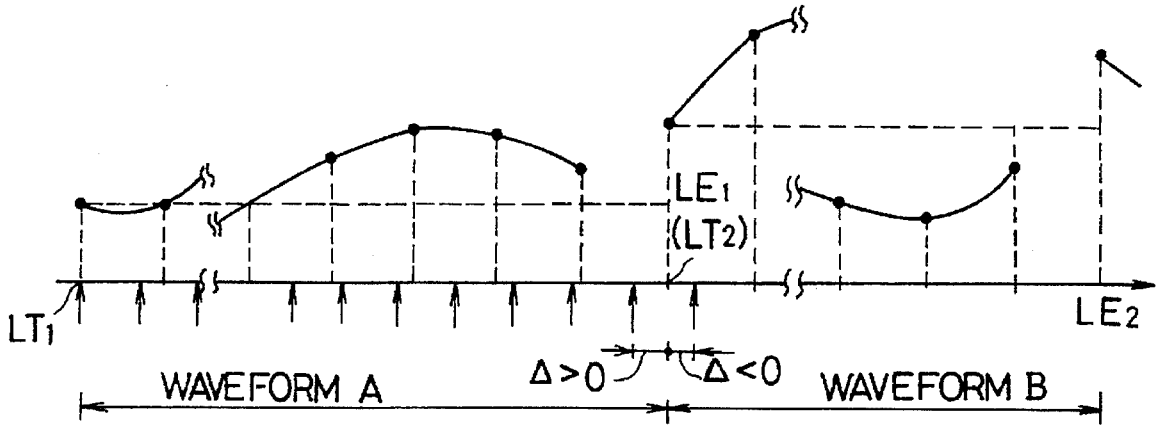
FIG. 3 is a drawing showing musical sound waveform data stored in the waveform memory of a first embodiment in a form of its waveform image.

FIG. 3 shows a state where musical waveform data (a waveform A and a waveform B) are stored in succession in the waveform memory 8. Namely, black dots in the drawing show musical sound waveform data stored in the waveform memory 8, and a position of each black dot shows a value in the vertical axial direction. This musical waveform data is stored in correspondence to each integral address of the horizontal axis.

Musical sound waveform data, with a specified length required to restore a musical sound waveform with one tone, have parts other than onset of the musical sound which are defined by both addresses of the loop-top LT and the loop-top LE. FIG. 3 shows a state where musical sound waveform data comprising musical sound waveforms to be repeated (musical sound waveform data without onset of the musical sound) are stored in succession. A range to be read out repeatedly is specified in a waveform A and a waveform B by a loop-top address $LT_1$ and the loop-end address $LE_1$ and by a loop-top address $LT_2$ and a loop-end address $LE_2$ respectively.

In this case, the loop-end address $LE_1$ of the waveform A is used only to detect the end of repetition, and as actual musical sound waveform data is not necessary, the address is defined at the same address as the loop-top address $LT_2$ of the next waveform B, and a first musical sound waveform data of the waveform B is stored at the address.

In this form, a musical sound with a specified pitch is obtained by sequentially reading out data stored at each address at a specified speed from the waveform memory 8 in which the musical waveform data is stored.

On the other hand, to generate a sound with a same tone but with a lower pitch than said specified one, a pitch between sampling positions (those indicated by ↑ marks) is made narrower, and the data is read out at the specified speed. Then, since the sampling positions do not match addresses in the waveform memory, the musical sound data is computed by means of interpolation.

Similarly, to generate a sound with the same tone but with a higher pitch than said specified one, a pitch between sampling positions is made wider than an actual address interval, the data is read at the specified speed, and the musical sound waveform data is computed by means of interpolation.

Figure 4:
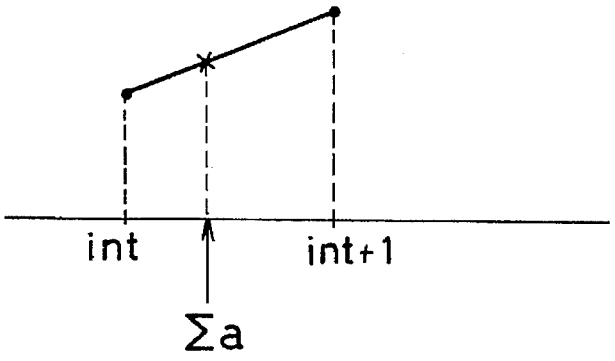
FIG. 4 is a drawing illustrating interpolation in the first or a second embodiment.

FIG. 4 shows the interpolating method. Namely, if a read-out address Σa, which is used as a sampling position, inludes a decimal part, a value to be stored at the read-out address Σa is computed according to the difference (slope) between contents stored at addresses shown by two integral numbers nearest to the read-out address "int" and "int+1".

Figure 5:
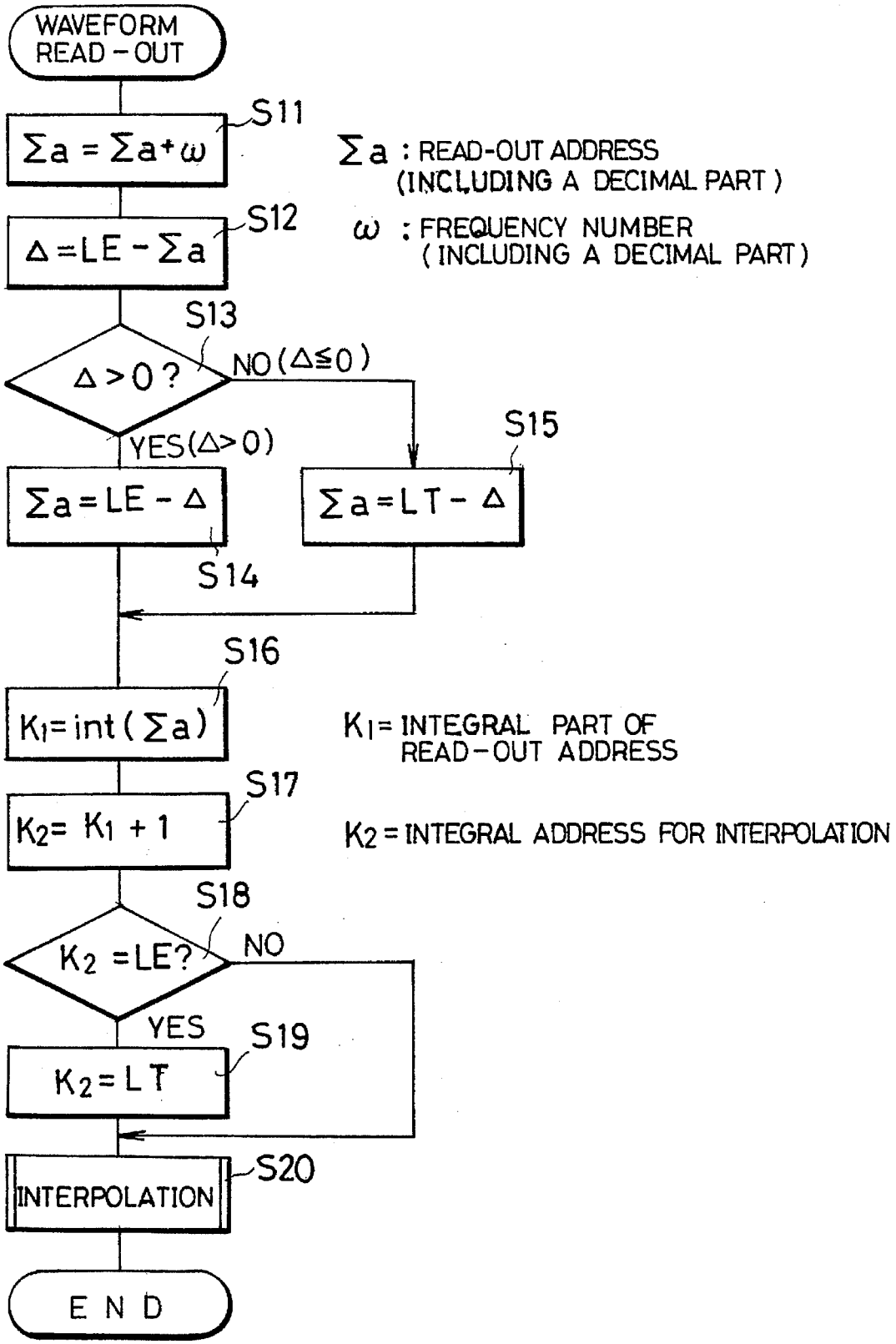
FIG. 5 is a flow chart to illustrate operations of a musical sound generating device in the first musical sound generating device.

FIG. 5 is a flow chart showing operations of a circuit to repeatedly read out musical sound waveform data and interpolate them (consisting of the address computing circuit 21 and the interpolating circuit 24).

First, the adder 20 computes the next read-out address Σa by adding the frequency number ω to a current read-out address Σa stored in the address computing circuit 21 (step S11). In the read-out address Σa which is a target for computing is included a decimal part, and its integral part is a read-out address for the waveform memory 8. The decimal part is used as a parameter in interpolating processing. Also, a decimal part is included in the frequency number ω, which defines a sampling pitch in an address space in the waveform memory 8. This sampling pitch corresponds to a key number, namely a pitch.

Then, a difference Δ is calculated by subtracting the next read-out address Σa from the loop-end address LE stored in an LE register (step S12), and whether the difference Δis larger than zero or not is checked. In other words, whether the next read-out address has surpassed the loop-end address or not is checked.

As shown in FIG. 3, if the difference Δ is larger than zero, or in other words, if the sampling position is not larger than the loop-end address LE, the current address Σa is restored by subtracting the difference Δ from the loop-end address (step S14). On the other hand, if the difference Δ is smaller than zero, or in other words, if the sampling position has surpassed the loop-end LE, the current address Σa is obtained by subtracting the difference Δ from the loop-top address LT (step 15). With this processing, the current address Σa is rounded to musical sound waveform data.

Then, an integral part of the current read-out address computed as described above is taken out as an integral part of the read-out address $K_1$ (step S16), and 1 is added to the integral address $K_1$ of this read-out address to make an integral address $K_2$ for interpolation (step S17). And, whether the integral address $K_2$ for interpolation is equal to the loop-end address LE is checked (step S18), and if equal, it means that the current read-out address Σa is in a range of $LE-1 \leqq \Sigma a < LE$, and the loop-top address used as the loop-top address is, the integral address $K_2$ for interpolation (step S19).

Then, the interpolation shown in FIG. 4 is performed (Step S20). This feature makes it possible to read out musical sound waveform data from a loop-end to a loop-top continuously, and also the released musical sound is smooth and continuous.

In a musical sound generating circuit with the configuration as described above, when reading out musical sound waveform data from the waveform memory 8, it is necessary to read out musical sound waveform data always checking whether the integral address $K_2$ for interpolation is equal to a final address (loop-end address LE) or not. For this reason, a circuit making comparison between the integral address $K_2$ for interpolation and the loop-end address LE is required. This means that the musical sound generating circuit becomes more complicated with larger scale. So, description is hereunder made for a second embodiment in which the way to store musical sound waveform data in the waveform memory 8 was improved and the necessity of the circuit to check whether the integral address $K_2$ is equal to the loop-end address LE was eliminated.

Figure 6:
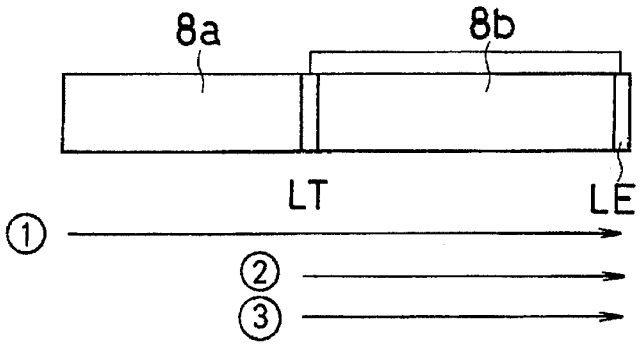
FIG. 6 is a drawing to illustrate a state of the musical sound waveform data, which is a portion of an original waveform in the second embodiment, being stored in the waveform memory as well as read-out operations.

In the waveform memory 8, as shown in FIG. 6, an onset part of the musical sound waveform data is stored in a zone 8*a*, and the repeated musical sound waveform data following it is stored in a zone 8*b*. When musical sound waveform data is read out and a sound is released, at first the musical sound data stored in the zone 8*a* and zone 8*b* indicated by an arrow 1 are read out in succession, and then only musical sound data stored in the zone 8*b* is read out, and after it, only the musical sound waveform data stored in the zone 8*b* is read out repeatedly, as shown by an arrow 3. This repeatedly read-out zone 8*b* is defined by the loop-top address LT and a loop-end address LE. This embodiment features that the same musical sound waveform data is stored in both of said loop-top address LT and said loop-end address LE.

Figure 7:
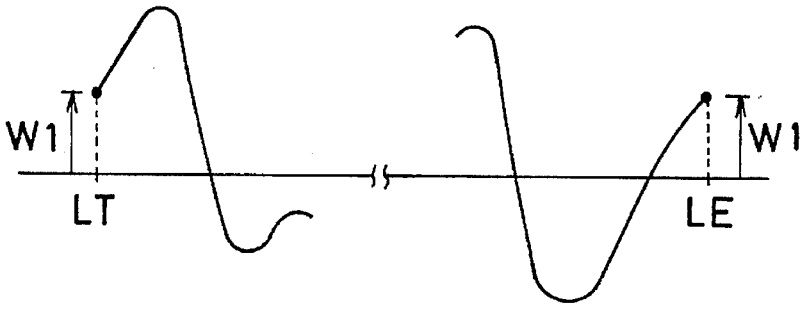
FIG. 7 is a drawing showing musical sound waveform data stored in the waveform memory in the second embodiment in a form of its waveform image.

FIG. 7 is a state of musical sound waveform data stored in the repeatedly read-out zone 8*b* expressed in a form of musical sound waveform image. As shown in this drawing, an identical piece of musical sound waveform data W1 is stored in both of the loop-top address LT and the loop-end address LE in the repeatedly read-out zone 8*b*.

Figure 8:
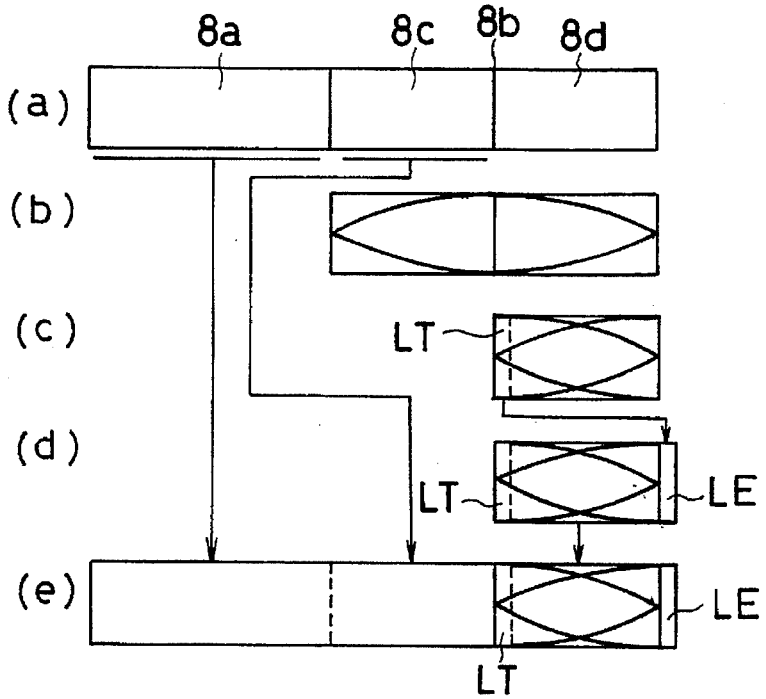
FIG. 8 is a drawing to illustrate a state of the musical sound waveform data generated by crossfading a portion of the original waveform in the second embodiment.

FIG. 8 shows other way to store musical sound waveform data. Namely, as shown in the drawing (a), a facility to generate musical sound waveform data to be stored in the waveform memory 8 using the onset zone 8*a* and the repeatedly read-out zone 8*b* following it is the same as that shown in FIG. 6, but the repeatedly read-out zone 8*b* is furthermore divided to two zones 8*c* and 8*d*, and as shown in FIG. 8 (*b*). An amplitude in the zone 8*c* is adjusted by weighing so that the zone is faded in, while an amplitude in the zone 8*b* is adjusted by weighing so that the zone is faded out. And, as shown in the drawing (c), each of said fade-in and fade-out musical sound waveform data are added to generate cross-fading musical sound waveform data. Then, as shown in the drawing (d), a head of the cross-fading musical sound waveform data is regarded as the loop-top address LT, and musical sound waveform data having the same contents is appended to the end, which is regarded as the loop-end address LE. The musical sound waveform data thus generated is linked to the end of the zone 8*c*, as shown in the drawing (e), and stored in the waveform memory 8. Thus, the same musical sound waveform data is stored at both of the loop-top address LT and the loop-end address LE.

Description is hereunder made for operations of the musical sound generating device with the afore said configuration and the aforesaid musical sound waveform data storage form.

Figure 9:
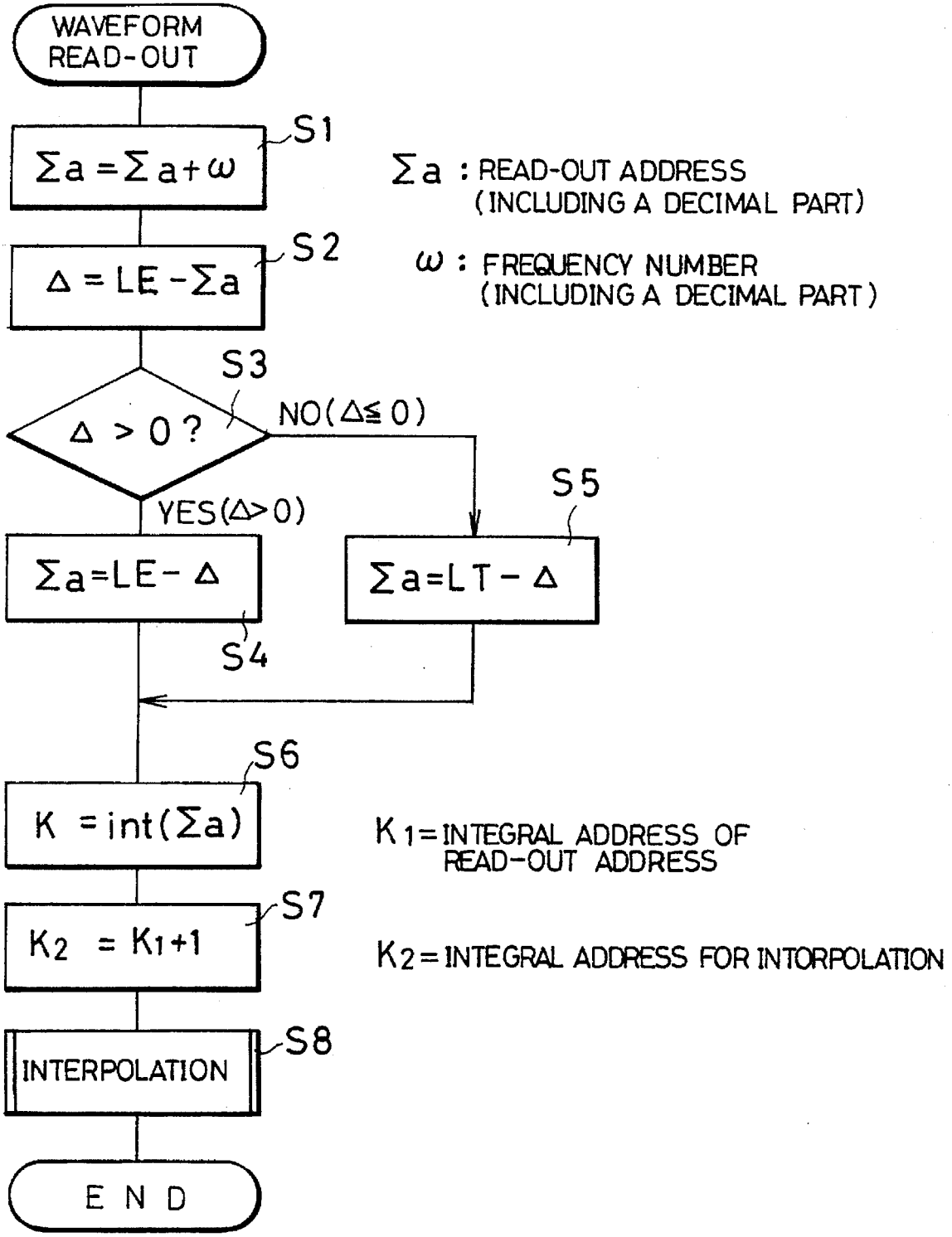
FIG. 9 is a flow chart to illustrate operations of the musical sound generating device in the second embodiment.

FIG. 9 shows operations of a circuit to repeatedly read out musical sound waveform data (consisting of an address computing circuit 21 and an interpolating circuit 24) in a flow chart.

First in the adder 20, a next read-out address Σa is computed by adding the frequency number ω supplied from CPU 4 to the current address Σa stored in an internal register (not shown ) in the address computing circuit 21 (Step S1). Said read-out address Σa includes a decimal part, as described above, and its integral part is supplied to the waveform memory 8 to become an address for reading out the musical sound waveform data, while the decimal part is supplied to the interpolating circuit 24 and used as a parameter for interpolating processing therein. Also, as described above, the frequency number ω is data including a decimal part.

Then, the difference Δ is computed by subtracting the next read-out address Σa obtained in step S1 from a loop-end address LE value stored in an LE register 23 (Step S2). And, whether the difference Δ is larger than zero or not is checked (Step S3). Namely, whether the next read-out address Σa has surpassed the loop-end address LE or not is checked.

If the difference Σa is larger than zero, namely if the sampling position has not surpassed the loop-end LE, the current read-out address Σa is restored by subtracting the difference Δ from the loop-end address (Step S4). On the other hand, if the difference Δ is smaller than zero, namely if the sampling position has surpassed the loop-end address LE, the current read-out address Σa is computed by subtracting the difference Δ from the loop-top address LT (Step S5). Because of this processing, the current read-out address Σa is rounded to a head of the waveform memory 8.

Then, a decimal part of the current address Σa computed in steps 4 and 5 above is taken out as an integral part $K_1$ of the read-out address (Step S6), while 1 is added to the integral part $K_1$ of the read-out address and the sum is regarded as the integral address $K_2$ for interpolation (Step S7).

Then, interpolation processing is carried out in the interpolating circuit 24 using the read-out address, the integral part $K_1$ of the read-out address, and the integral address $K_2$ for interpolation (Step S8).

Then, if the current address Σa is in the range of $LE-1 \leqq \Sigma a < LE$, interpolation processing is performed using "LE−1" as the integral part $K_1$ of the read-out address and "LE" as the integral address $K_2$ for interpolation. However, as the same contents as that stored at LT are stored at LE, consequently interpolating processing is performed using "LE−1" as the integral part $K_1$ of the read-out address and "LT" as the integral address $K_2$ for interpolation. With this, musical sound waveform data can be read out from the loop end to the loop top continuously, and a smooth and continuous musical sound is obtained.

Comparison between a processing in the embodiment according to the present invention shown in in FIG. 9 and that shown in FIG. 5 shows that, under the configuration as described above, the hardware required to carry out operations in steps S18 and S19 in FIG. 5, namely, a circuit making a comparison between the integral address $K_2$ for interpolation and the loop-end address LE and a control circuit to use the loop-end address LE as the integral address $K_2$ for interpolation are not necessary in the embodiment according to the present invention.

Thus, when storing musical sound waveform data in the waveform memory 8, the data is stored in a range from the loop-top address LT (integral address increased) to an address by 1 ahead of the loop-end address LE (integral address), the same musical sound waveform data as that stored at the loop-top address LT is stored at the loop-end address LE (integral address), musical sound waveform data for the next waveform is stored from an integral address next to the loop-end address LE, and when interpolation is made by repeatedly reading out musical sound waveform data, interpolation can be made without determining whether interpolation has surpassed the loop-end address LE, so that a memory space for only 1 word is used when storing musical sound data in the waveform memory 8 and hardware for detecting a loop-end is not necessary, which means the possibility of minimizing scale of a circuit as well as realizing an inexpensive device.

Although description of the aforesaid embodiment is based on the assumption that an address computing function in the address computing circuit 21 and an interpolating function in the interpolating circuit 25 can be realized by hardware, these functions may be realized with a processor.

As described above in detail, this invention makes it possible to minimize the scale of a circuit for interpolation, and accordingly to provide a musical sound generating device which allows price reduction.

We claim:

1. A musical sound generator comprising:

means receptive of frequency data for producing read-out addresses and interpolation data associated therewith;

a waveform memory for storing musical sound data associated with the read-out addresses in address locations between a loop-top address and a loop-end address, wherein the data stored in the loop-end address is the same as the data stored in the loop-top address and is used only for interpolation;

means receptive of the read-out addresses for producing a corrected read-out address for each read-out address in accordance with a difference between respective read-out addresses and the loop-end address;

means for repeatedly reading out musical sound data from the corrected read-out address locations in the waveform memory between the loop-top address and an address location which is just previous to the loop-end address to produce a continuous musical sound waveform; and means receptive of the interpolation data including the data in the loop-end address for performing an interpolation of read-out musical sound data for a subsequent read-out of musical sound data between the loop-top address and said address just previous to the loop-end address to effect a smooth continuous sound waveform;

wherein the means for producing a corrected read-out address for each read-out address includes means for subtracting a read-out address from the loop-end address to produce a value Δ, and setting the corrected read-out address equal to the difference between the loop-end address and Δ when Δ is greater than zero and equal to the difference between the loop-top address and Δ when Δ is less than zero.

2. A musical sound generator according to claim 1; wherein the musical sound data stored in said waveform memory corresponds to a musical sound waveform of a specified length, and wherein a head of the musical sound waveform is stored at the loop-top address and at the loop-end address.

3. A musical sound generator according to claim 1; wherein the musical sound waveform data stored in said waveform memory corresponds to a cross-faded sound waveform of a specified length, and wherein a head of the musical sound waveform is stored at the loop-top address and at the loop-end address.

4. A musical sound generator according to claim 1; wherein the means for producing a read-out address comprises a wired logic circuit.

5. A musical sound generator according to claim 1; wherein the means for producing a read-out address comprises a processor.

6. A musical sound generator according to claim 1; wherein the means for producing a read-out address comprises means for generating read-out addresses incrementally at an interval corresponding to pitch.

7. A musical sound generator according to claim 1; wherein the means for performing an interpolation comprises a wired logic circuit.

8. A musical sound generator according to claim 1; wherein the means for performing an interpolation comprises a processor.

9. A musical sound generator according to claim 1; wherein the sound waveform data between the loop-top address and said address just previous to the loop-end address extends over at least one period.

10. A musical sound generator according to claim 1; wherein the read-out address contains an integral part and a decimal part constituting the interpolation data.

11. A musical sound generator according to claim 10; wherein the means for performing an interpolation includes means receptive of the decimal part for interpolating the data stored at the loop-end address for the next read-out at the loop-top address.

12. A method of generating a musical sound, comprising the steps of:

producing read-out addresses and interpolation data associated therewith from frequency data;

storing musical sound data associated with the read-out addresses in a waveform memory in address locations between a loop-top address and a loop-end address, wherein the data stored in the loop-end address is the same as the data stored in the loop-top address and is used only for interpolation;

producing a corrected read-out address for each read-out address in accordance with a difference between respective read-out addresses and the loop-end address;

repeatedly reading out musical sound data from the corrected read-out address locations in the waveform memory between the loop-top address and an address location which is just previous to the loop-end address to produce a continuous musical sound waveform; and performing an interpolation of read-out musical sound data as a function of the data in the loop-end address and the interpolation data for a subsequent read-out of musical sound data between the loop-top address and said address just previous to the loop-end address to effect a smooth continuous sound waveform;

wherein the step of producing a corrected read-out address includes the step of subtracting a read-out address from the loop-end address to produce a value Δ, and setting the corrected read-out address equal to the difference between the loop-end address and Δ when Δ is greater than zero and equal to the difference between the loop-top address and Δ when Δ is less than zero.

13. A method according to claim 12; wherein the musical sound data stored in said waveform memory corresponds to a musical sound waveform of a specified length, and wherein a head of the musical sound waveform is stored at the loop-top address and at the loop-end address.

14. A method according to claim 12; wherein the musical sound waveform data stored in said waveform memory corresponds to a cross-faded sound waveform of a specified length, and wherein a head of the musical sound waveform is stored at the loop-top address and at the loop-end address.

15. A method according to claim 12; wherein the read-out address is produced by a wired logic circuit.

16. A method according to claim 12; wherein the read-out address is produced by a processor.

17. A method according to claim 12; wherein read-out addresses are generated incrementally at an interval corresponding to pitch.

18. A method according to claim 12; wherein the interpolation is performed by a wired logic circuit.

19. A method according to claim 12; wherein the interpolation is performed by a processor.

20. A method according to claim 12; wherein the sound waveform data between the loop-top address and said address just previous to the loop-end address extends over at least one period.

21. A method according to claim 12; wherein the read-out address contains an integral part and a decimal part constituting the interpolation data.

22. A method according to claim 21; wherein the interpolation is performed by receiving the decimal part of the address for interpolating the data stored at the loop-end address for the next read-out at the loop-top address.

23. A musical sound generator comprising: means receptive of frequency data for producing read-out addresses and interpolation data associated therewith; a waveform memory for storing musical sound data associated with the read-out addresses in address locations between a loop-top address and a loop-end address; means receptive of the read-out addresses for producing a corrected read-out address for each read-out address in accordance with a difference between respective read-out addresses and the loop-end address, the means for producing a corrected read-out address for each read-out address including means for subtracting a read-out address from the loop-end address to produce a value Δ, and setting the corrected read-out address equal to the difference between the loop-end address and Δ when Δ is greater than zero and equal to the difference between the loop-top address and Δ when Δ is less than zero; means for repeatedly reading out musical sound data from corrected read-out address locations in the waveform memory between the loop-top address and the loop-end address to produce a continuous musical sound waveform; and means receptive of the interpolation data including data for performing an interpolation of read-out musical sound data to effect a smooth continuous sound waveform.

24. A method of generating a musical sound, comprising the steps of: producing read-out addresses and interpolation data associated therewith from frequency data; storing musical sound data associated with the read-out addresses in a waveform memory in address locations between a loop-top address and a loop-end address; producing a corrected read-out address for each read-out address in accordance with a difference between respective read-out addresses and the loop-end address by subtracting a read-out address from the loop-end address to produce a value Δ, and setting the corrected read-out address equal to the difference between the loop-end address and Δ when Δ is greater than zero and equal to the difference between the loop-top address and Δ when Δ is less than zero; repeatedly reading out musical sound data from the corrected read-out address locations in the waveform memory between the loop-top address and the loop-end address to produce a continuous musical sound waveform; and performing an interpolation of read-out musical sound data to effect a smooth continuous sound waveform.

* * * * *